US006080257A

United States Patent [19]

Magoffin

[11] Patent Number: 6,080,257

[45] Date of Patent: Jun. 27, 2000

[54] MULTI-FOLD MAT STRUCTURE

[75] Inventor: Howard G. Magoffin, St. Louis, Mo.

[73] Assignee: Western Plastics, Inc., St. Louis, Mo.

[21] Appl. No.: 09/045,231

[22] Filed: Mar. 21, 1998

[51] Int. Cl.[7] ..... D04H 3/16; B27N 3/10

[52] U.S. Cl. ..... 156/167; 156/181; 156/257; 264/167; 264/168; 264/257

[58] Field of Search ..... 428/53, 156, 167, 428/171; 5/42; 15/215; 442/327; 248/345.1; 156/167, 181, 219, 296, 257, 308.2; 264/257, 167, 168

[56] References Cited

U.S. PATENT DOCUMENTS

| | | | |
|---|---|---|---|
| 304,128 | 8/1884 | Potts | 15/215 |
| 3,092,529 | 6/1963 | Pzavson | 154/44 |
| 3,615,149 | 10/1971 | Malone et al. | 138/151 |
| 4,351,683 | 9/1982 | Kusilek | 156/167 |
| 4,837,066 | 6/1989 | Quinn et al. | 425/95 |
| 5,055,151 | 10/1991 | Duffy | 156/167 |

*Primary Examiner*—Donald Loney
*Attorney, Agent, or Firm*—Polster, Lieder, Woodruff & Lucchesi, L.C.

[57] ABSTRACT

A protective cover for application to multi-surface or multi-faceted structures or objects, such as posts, piers, stairs, which have two or more parallel edges or corners. The protective cover includes a foldable elongated flexible sheet of shock absorbing material adapted to be folded about the structure. The foldable elongated flexible sheet of shock absorbing material includes spaced apart fold lines that extend in the same direction as the edges or corners the fold lines are to fold about. The foldable elongated flexible sheet preferably comprises a flexible porous filamentary cover.

4 Claims, 3 Drawing Sheets

MULTI-FOLD MAT STRUCTURE

CROSS-REFERENCE TO RELATED APPLICATIONS

This is a patent application to U.S. patent application Ser. No. 09/045,230, filed Mar. 20, 1998 now U.S. Pat. No. 5,988,227, entitled PROTECTIVE SHIELD FOR ELONGATED UNDERGROUND UTILITIES of the same inventor.

STATEMENT REGARDING FEDERALLY SPONSORED RESEARCH OR DEVELOPMENT

Not Applicable.

BACKGROUND OF THE INVENTION

This invention relates to a flexible, foldable cover which can be used as a pad, bumper, etc. to protect and to provide cushioning around multi-surfaced structures, such as piers, posts, and stairs, for example.

Bumpers and cushioning pads are used where it is necessary to protect objects against impacts with stationary structures, or simply to provide cushioning underfoot. Where the surface to be protected is generally flat, a simple pad or cushion can be easily secured to the surface. However, where the structure is multi-faceted (i.e. is triangular, square, hexagonal, octagonal, etc. in cross-section), a simple cover cannot easily be applied to the structure or object to be protected. Such a cannot easily be wrapped about the edges or comers of such structures. This is especially true when the cover is thick and the structure is fairly small in cross-sectional area. In such instances, the cover will form a large radius about the edge or corner. This, however, is not desirable in all circumstances. Further, it may be difficult to apply conventional bumpers or pads to certain structures to protect the structure or to protect objects adjacent the structure.

For example, bumpers are typically used in marinas on docks and associated piers and posts to protect boats from impacts with the docks. Such bumpers often include tires or other types of discrete bumpers which are fixed to the docks and the posts or piers which support the dock. While these bumpers will protect boats from impacts with docks and their associated posts as long as the boat is along side the dock, because the bumpers are spaced apart, a boat can still bump against an unprotected portion of the dock or pier. Further, the bumpers can be heavy, and are difficult to attach to the dock and associated posts.

It is also desirable to apply coverings to stairs in areas such as marina, factories, etc. where a durable, long-lasting covering is desired to increase traction for those walking over the surface. Available coverings are thin, and wear quickly. They therefore need to be replaced frequently. Thicker coverings, which may be more durable, are difficult to apply to stair cases because they cannot be easily applied to the comers of the stairs. When they are applied to the comers of the stairs, large radiuses are formed which can interfere with a person walking up or down the stairs.

BRIEF SUMMARY OF THE INVENTION

Among the several objects and advantages the present invention include:

the provision of a new and improved protective cover which can be applied as a bumper or cushion in a variety of environments;

the provision of the aforementioned protective cover which can be quickly and easily applied in the field without substantial labor;

the provision of the aforementioned protective cover which includes at least two fold lines which extend in a direction to enable the cover to be easily applied to a desired multi-urfaced or multi-faceted structure;

the provision of the aforementioned protective cover which is constructed as a flexible porous cover; and the provision of the aforementioned protective cover which is efficient and economical to manufacture, is capable of being wound into a roll for shipping purposes, can be manufactured and/or cut in any desired width or length for desired applications, does not deteriorate when in use, and is otherwise will adapt for the purposes intended.

Briefly stated, the protective cover of the present invention is constructed for use with multi-surfaces structures wherein the structure's surfaces are connected by parallel edges or corners, such as posts, stairs, etc. The protective cover includes a foldable elongated flexible sheet of shock absorbing cover adapted to be applied to the structure. The foldable elongated flexible sheet of shock absorbing material includes at least two spaced-apart parallel fold lines.

The flexible sheet of shock absorbing material preferably comprises a flexible porous filamentary cover made of a plurality of elongated filaments of thermoplastic and resilient, shock absorbing material arranged in an irregular pattern of overlapped and interengaged filaments. The cover is formed by laying down the filaments to a desired depth. The filaments are in a heated state when laid down so that they will fuse together to form the porous mat. The fold lines, which define grooves, are preferably formed in the cover while the filaments are still in their heated condition. For example, a cold roller is used rolled across the mat, while the cover is supported on a surface, to form a groove or channel of a desired depth. This groove or channel defines the fold lines. The fold lines are all formed in the same surface of the mat. The fold lines can extend the length of the cover or the width of the mat, depending upon the application to which the cover will be applied.

The protective cover may be made in any width or length as desired, but preferably is designed to be wound on itself to facilitate shipping, handling and subsequent use in the field. Additionally, the spacing between the fold lines can be varied, depending on the dimensions of the surfaces to which the cover will be applied.

These and other objects and advantages of the present invention will become apparent from the discussion that follows.

BRIEF DESCRIPTION OF THE SEVERAL VIEWS OF THE DRAWINGS

In the drawings.

Corresponding reference numerals will be used throughout the various figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

The protective cover of the present invention is constructed for the use and protection and/or cushioning of multi-surfaced objects, such as posts, piers, and stairs, for example. It will become apparent that the protective cover of the present invention can be quickly, conveniently and easily applied with a minimum of skill and effort, resulting in significant labor savings, as well.

Figure 1:
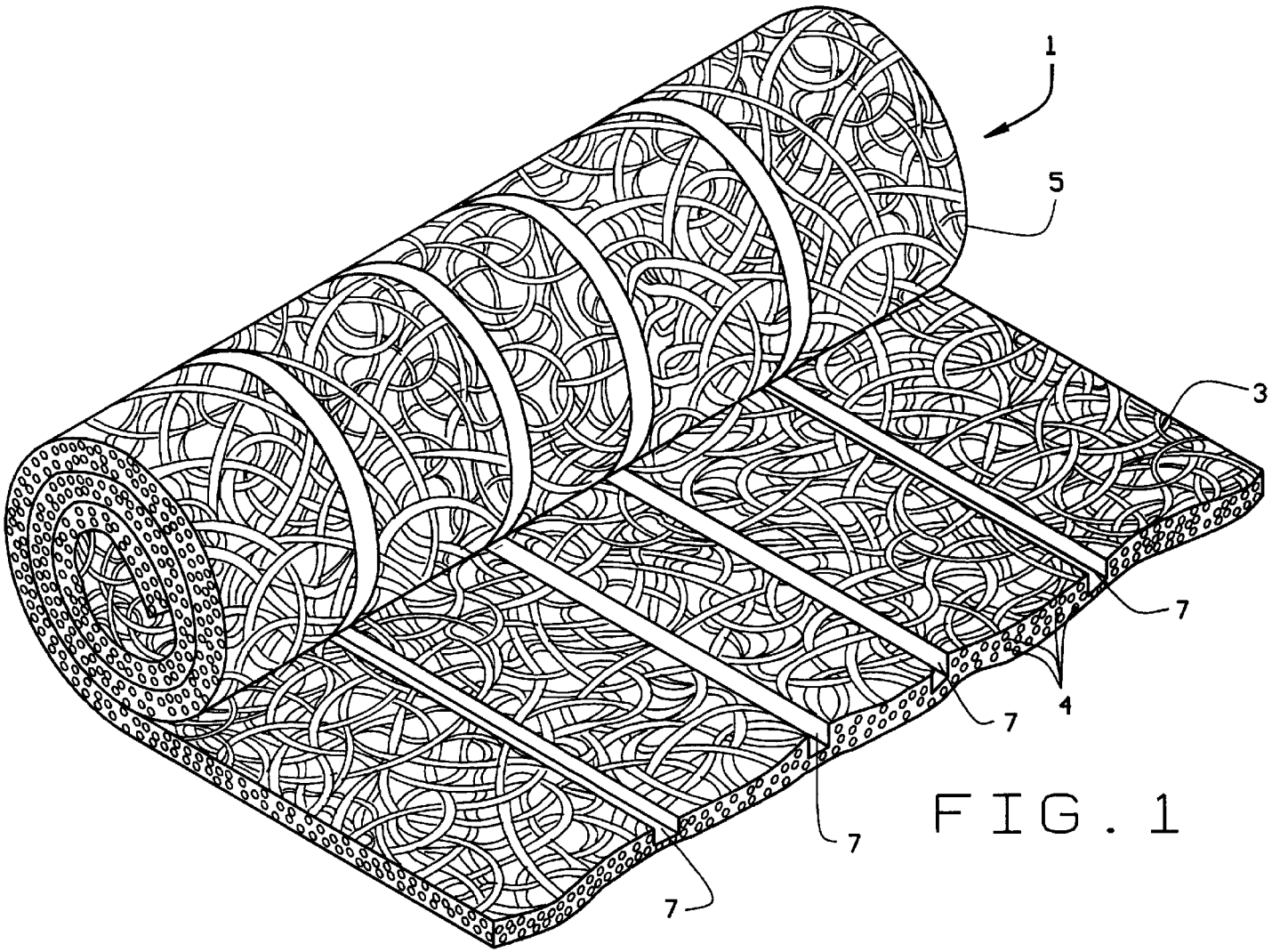
FIG. 1 is a fragmentary top perspective view of a foldable elongated flexible sheet of shock absorbing material wound in a roll to facilitate shipping, handling and subsequent use in the field.
Figure 2:
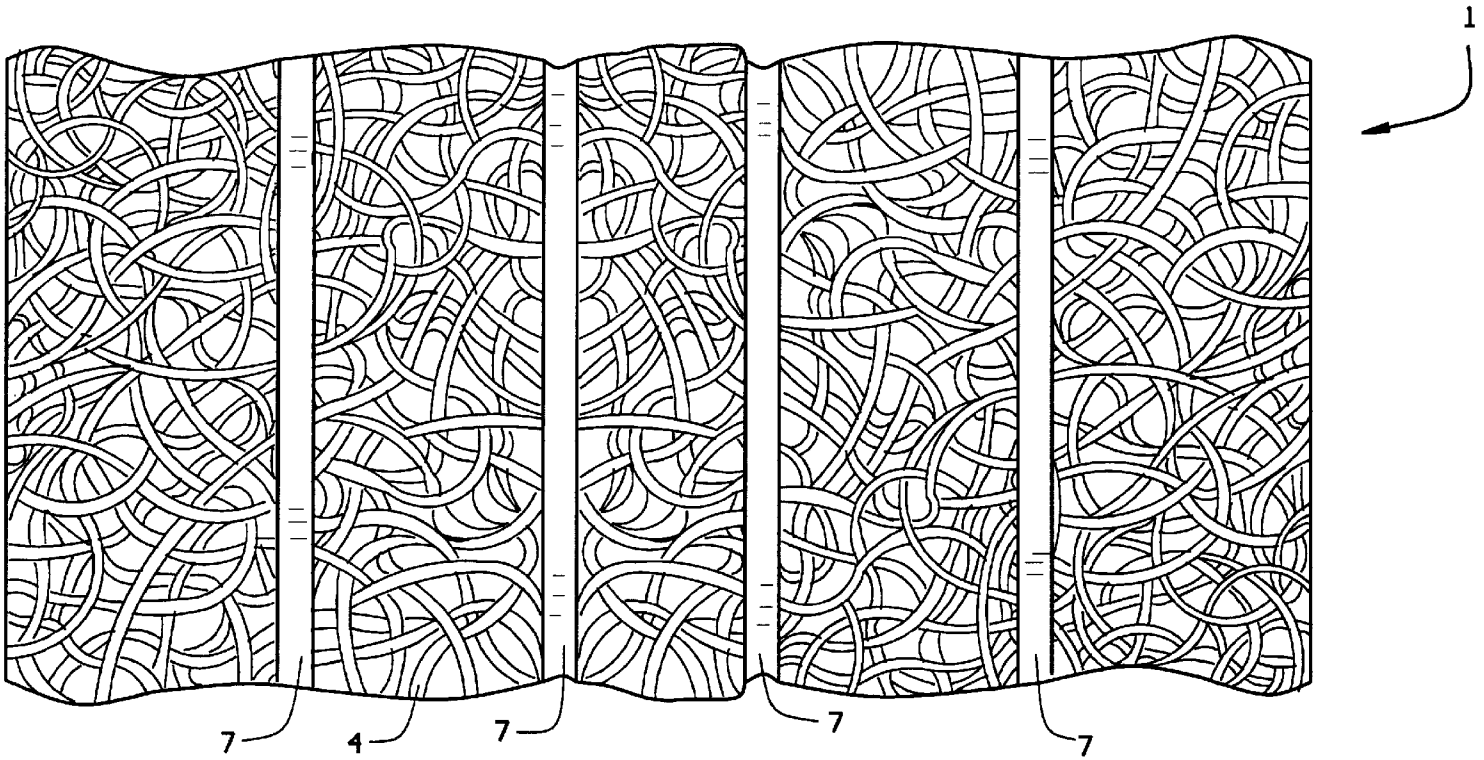
FIG. 2 is a fragmentary top plan view of the foldable elongated flexible sheet of the present invention.
Figure 3:
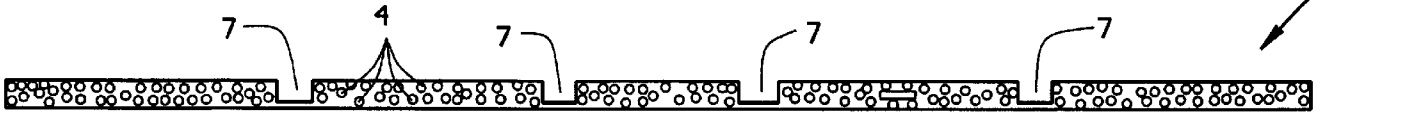
FIG. 3 is a end elevational view of the foldable elongated flexible sheet of shock absorbing material shown in FIG. 2.
Figure 4:
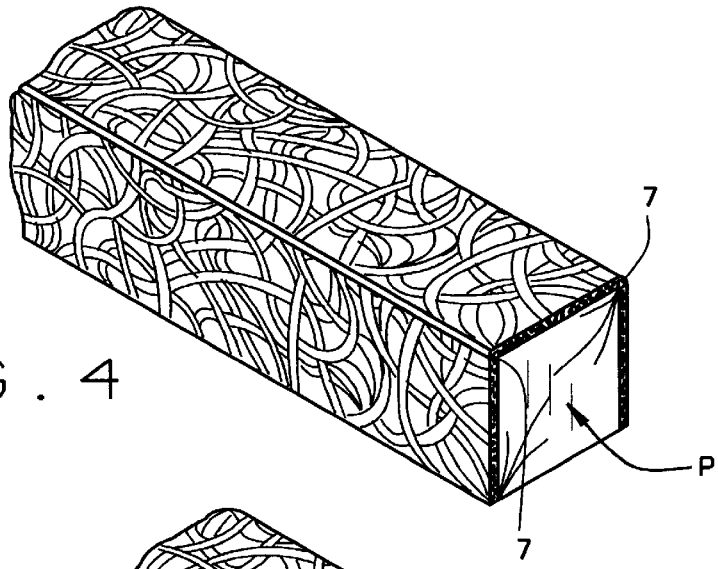
FIG. 4 is a fragmentary side perspective of the foldable elongated flexible sheet of the present invention applied to a post or pier.
Figure 5:
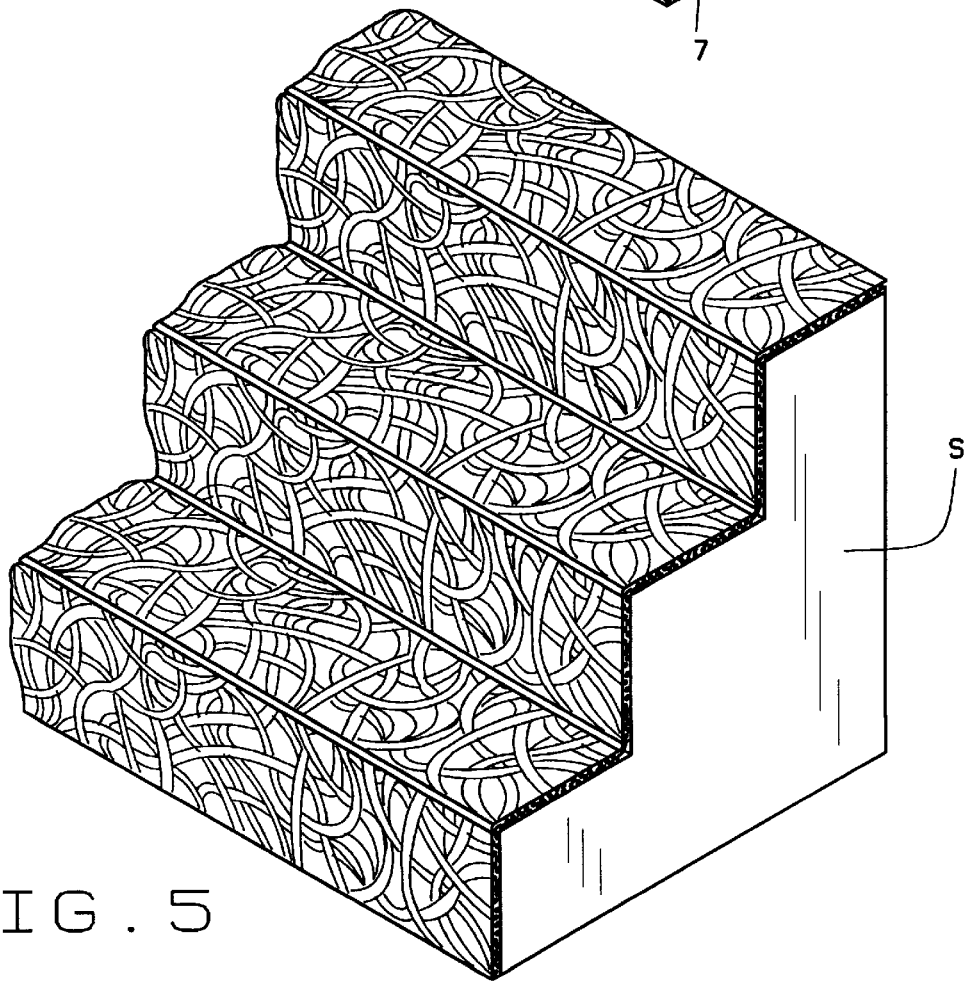
FIG. 5 is a perspective view of the foldable elongated flexible sheet of material folded to be applied to a staircase.

The protective cover 1 of the present invention is best shown in FIGS. 1–3 of the drawings with its use or application shown in FIGS. 4–5 of the drawings. The protective cover 1 is shown in FIGS. 4–5 of the drawings as protecting a pier or post P in FIG. 4 and is shown folded in FIG. 5 to be applied to a staircase S.

FIGS. 1–3 of the drawings best illustrate the construction of the protective cover 1 of the present invention. There, it will be seen that the protective cover 1 includes a flexible sheet of shock absorbing material 3 which preferably has a porous or open weave construction. As illustrated in the drawings, the flexible sheet of shock absorbing material 3 comprises a porous filamentary cover which includes a plurality of elongated filaments 4 of thermoplastic and resilient materials. The filaments are preferably made from a polyvinyl chloride. The plurality of elongated filaments of thermoplastic and resilient material are arranged in an irregular pattern of overlapping and interengaging filaments, as illustrated. This provides a flexible cover or sheet 3 which is capable of being wound into a roll 5 as illustrated in FIG. 1 of the drawings for transportation and storage purposes. The flexible sheet of shock absorbing material 3, due to its porous or open weave construction and sufficient height such as that illustrated in FIGS. 1–3, provides a durable, long-lasting sheet of shock absorbing material 3 for use as the protective cover 1 of the present invention.

The porous filamentary cover 3 may be made in various constructions and by a variety of different methods. One particular efficacious method is shown in U.S. Pat. No. 4,351,683 as one preferred procedure for making open porous integrated filamentary covers. Another method for making a porous filamentary cover is disclosed in U.S. Pat. No. 5,055,151. Briefly stated, thermoplastic filaments are laid down on a surface in an irregular pattern of overlapping and interengaging filaments until a desired depth of the sheet is reached. The filaments are in a heated condition when laid down, and hence fuse together to form the porous filamentary sheet 3 which can then be cut into covers 1 of a desired length. The above patents, which are incorporated herein by reference, illustrate several different types and constructions of porous filamentary covers which can be used as the flexible sheet or cover of shock absorbing material 3 in the protective cover 1 of the present invention. Obviously, other methods than those disclosed in the aforementioned patents and other flexible sheets of shock absorbing material 3 can be used in forming the protective cover 1 of the present invention. For example, a porous sheet of foam plastic material could be used as well as other types of shock absorbing sheets, as may be desired.

During manufacture, two or more spaced-apart, parallel fold lines 7 are formed in the sheet 3, prior to the sheet 3 being wound into the roll 5. During the manufacture of the porous filamentary cover of flexible sheet of shock absorbing material 3 shown in FIGS. 1–3 of the drawings, it will be understood that the plurality of elongated filaments 4 of thermoplastic and resilient material are in a heated condition following placement in the irregular pattern of overlapped and interengaged filaments shown in FIGS. 1–3. A cold roller element (not shown), having approximately the same width as each fold line 7, is forced into the still heated plurality of elongated filaments to form the fold lines 7. Typically, the cold roller elements (not shown) are spaced a desired distance from an underlying web or table that supports the porous filamentary cover of shock absorbing material 3 in order to form the fold lines 7 with the size and depth such as that illustrated in FIGS. 2 and 3 of the drawings. As can be appreciated, the fold lines are formed by compressing the filaments 4 together.

The fold lines, alternatively, could be formed after the thermoplastic filaments have fused and cooled using a heated roller. This heated roller would heat and compress the filaments to form the fold lines 7. In either method, when the fold lines 7 extend the length of the sheet 3, rollers are preferably used to form the fold lines. However, when the fold lines 7 extend across the width of the mat, an elongate bar could be used in place of the rollers to compress the filaments 4 to form the fold lines 7.

For an elongate structure, such as a post or pier, the fold lines 7 extend in the same direction as the elongated flexible sheet of shock absorbing material 3, as illustrated in FIGS. 1–3. However, in an installation, such as a staircase, where it is desirable to fold the sheet 3 is a direction perpendicular to the direction of the sheet, the fold lines 7 preferably extend across the cover 3, perpendicular to the direction of the cover.

Following the manufacture of the porous filamentary of shock absorbing material 3 with the spaced-apart fold lines 7 shown in FIGS. 1–3 of the drawings, the cover of shock absorbing material 3 is preferably wound into the roll 5 for storage and transportation services. Although the roll 5 can be wound in the same direction as the fold lines 7, as shown in FIG. 1, the roll can also be wound in a direction perpendicular to the fold lines 7.

When shipped to a construction site, the protective cover 1 is ready for immediate use, without any fastening strip or other fastening means. In fact, very little effort is required in positioning the protective cover 1 about a desired structure. As illustrated in FIG. 4, the cover 1 is positioned on one surface of the post P such that the fold lines are aligned with the edges or comer of the post. The roll 5 is then simply unrolled or unwound against the post or pier P, cut to the appropriate length, and folded about its fold lines such that the surfaces of the cover 1 are adjacent the surface of the post P. The cover 1 is then secured to the post P with any type of conventional fastener. Alternatively, the cover 1 can be secured to the post P with an adhesive (i.e., a tape or a glue). This would require that the adhesive be applied to the post P or cover 1 prior to unrolling the cover.

The post P in FIG. 4 is shown to be a four-sided post, and the cover is shown to cover three sides of the post. The cover can be made wider to cover all four surfaces of the post, if desired. Additionally, the post could be of any other polygonal shape, e.g., triangular, hexagonal, octagonal, etc. All that is required, is that the appropriate number of fold lines 7 be formed in the cover in the appropriate spacing to surfaces of the post. Thus, the spacing between the fold lines 7 is approximately equal to the width of the surfaces of the post P.

In FIG. 5, the protective cover 1 is shown applied to a staircase S. Unlike the cover 1 used for the posts P, the fold lines 7 in the cover used for the staircase S extend across the width of the sheet 3, perpendicular to the direction of the sheet 3. The fold lines 7 are spaced apart to form sections equal to the length or depth of the treads and risers of the staircase S. To apply the cover to the staircase S, the roll 5 is positioned at one end of the staircase S (either the top or bottom) and unrolled the length of the staircase. The fold lines 7, as noted, are positioned to be aligned with the comers between the threads and the riser. Thus, the cover will lie flat against all surfaces of the stair case, and there will be substantially no radiused comers which would interfere with a carpet installation.

In view of the above, it will be seen that the several objects and features of this invention are achieved in other advantageous results obtained. As various changes could be made in the above constructions without departing from the scope of the invention, it is intended that all matter contained in the above description are shown in the accompanying drawings shall be interpreted as an illustrative and not in a limiting sense.

What is claimed is:

1. A method of making a porous, flexible, foldable filamentary cover made by:

laying down a plurality of elongated thermoplastic filaments in an irregular overlapping and interengaging pattern to a desired depth, the filaments being in a heated state when laid down;

fusing the heated filaments together; and forming two or more spaced apart fold lines in the cover by compressing and fusing the filaments together while the filaments are still hot, the fold lines being formed by cold rollers.

2. The method of claim 1 wherein the fold lines extend substantially the length of the cover.

3. The method of claim 1 wherein the fold lines extend across the width of the length of the cover.

4. The method of claim 1 wherein the cover has a first surface and a second surface, the fold lines being formed in the first surface.

* * * * *